United States Patent [19]

Brady et al.

[11] 3,973,420

[45] Aug. 10, 1976

[54] LOCK FOR MEDICINE CABINETS AND THE LIKE

[76] Inventors: Steven F. Brady, 8735 Contee Road, Laurel, Md. 20810; James Patrick Edelmann, 10439 Naglee Road, Silver Spring, Md. 20903

[22] Filed: May 16, 1975

[21] Appl. No.: 578,182

[52] U.S. Cl. ..... 70/78; 70/85; 70/90; 70/101

[51] Int. Cl.[2] ..... E05B 65/44

[58] Field of Search ..... 70/14, 15, 39, 78, 79, 70/80, 81, 85, 86, 89, 90, 95, 99, 100, 101, 19, 32, 33, 34, 58, 59, 60, 61, 62, 158, 159, 129, 132, 134, DIG. 9, DIG. 19

[56] References Cited

UNITED STATES PATENTS

| | | | |
|---|---|---|---|
| 2,172,208 | 9/1939 | Kurtzon | 70/14 |
| 2,716,881 | 9/1955 | Terrill | 70/14 |
| 2,737,043 | 3/1956 | Blohm | 70/14 |
| 2,759,492 | 8/1956 | Benson | 70/14 X |

FOREIGN PATENTS OR APPLICATIONS

| | | | |
|---|---|---|---|
| 13,945 | 1/1902 | United Kingdom | 70/19 |

*Primary Examiner*—Robert L. Wolfe
*Attorney, Agent, or Firm*—Brady, O'Boyle & Gates

[57] ABSTRACT

A lock for medicine cabinet doors and the like has a base or mounting element attachable to a cabinet side wall. A retaining and guidance bar for a lock body extends from the base element laterally outwardly of the cabinet side wall. A lock body having a key operable tumbler cylinder is movable on said retainer and guidance bar between locking and release positions. A cabinet closure locking member or "bolt" secured to the lock body and parallel with the retainer and guidance bar and offset therefrom blocks the opening of the cabinet closure when the lock body is in the locking position.

16 Claims, 12 Drawing Figures

FIG. 2
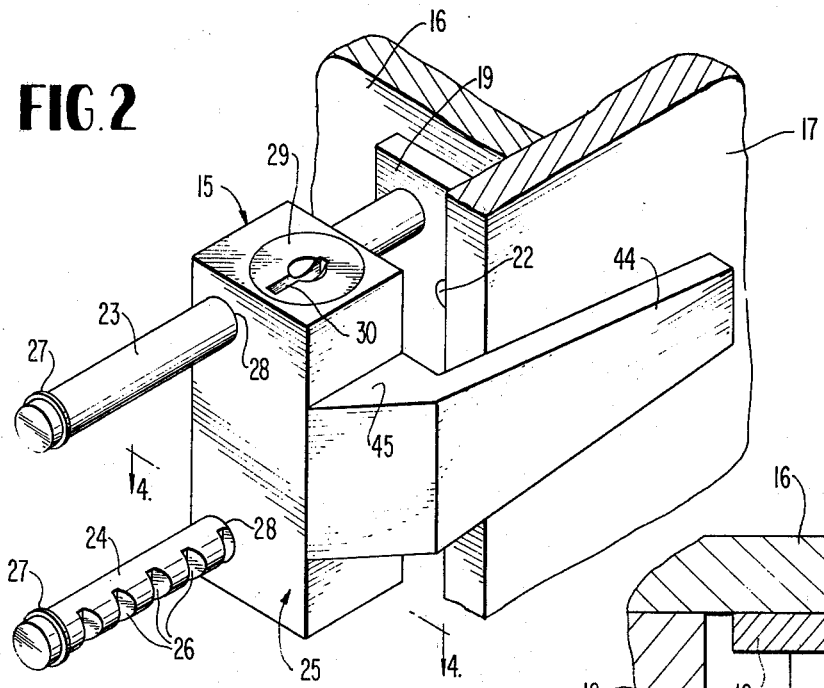
FIG. 3
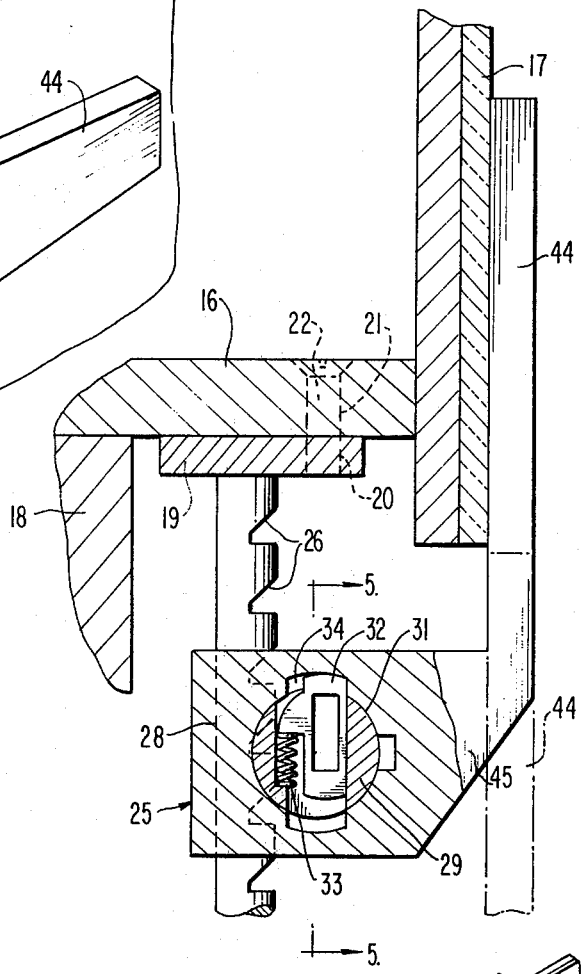
FIG. 4
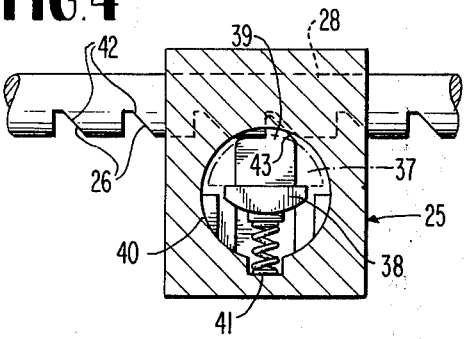
FIG. 5
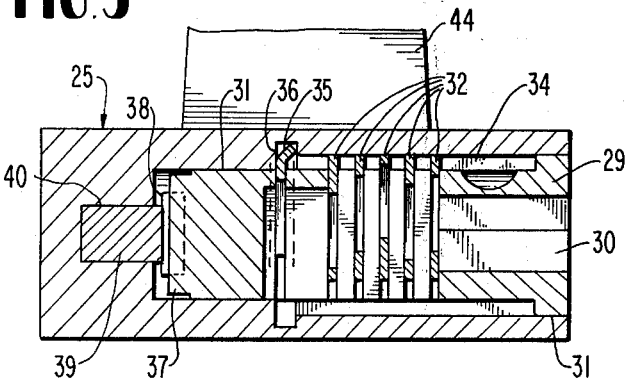
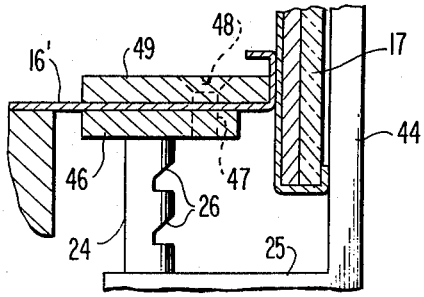
FIG. 6
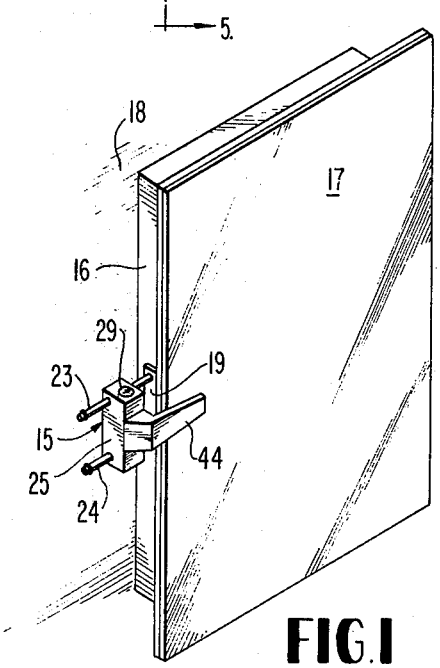
FIG. 1

FIG.7
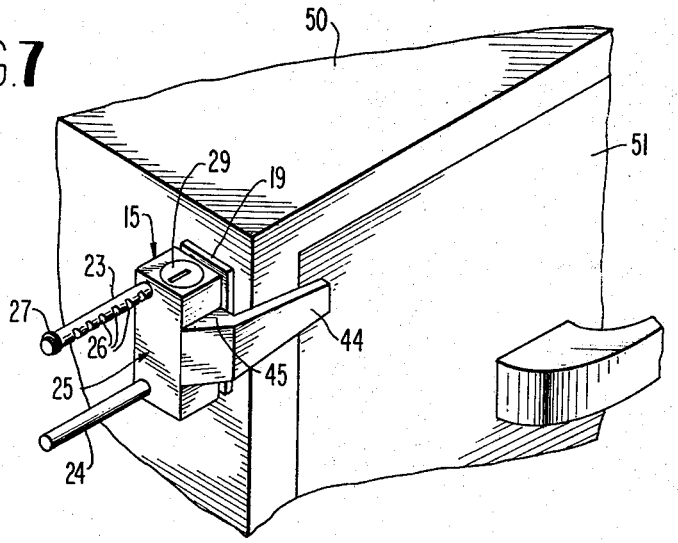
FIG.8
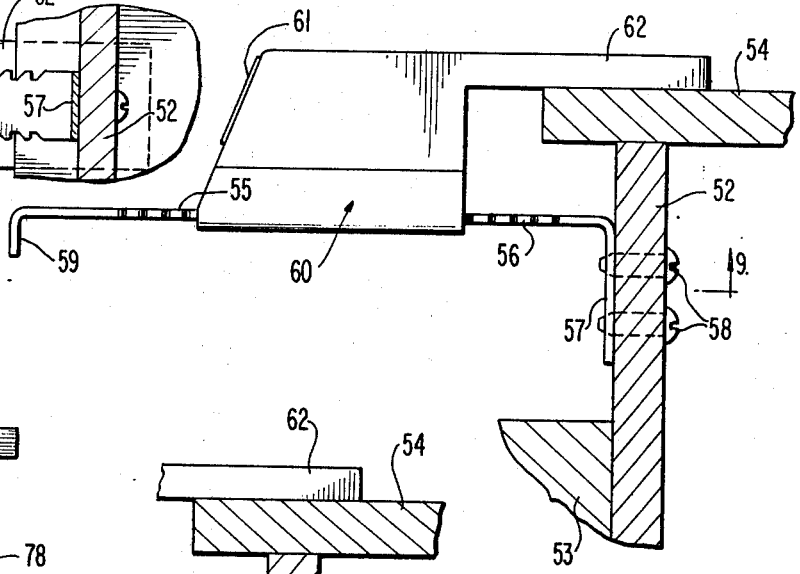
FIG.9
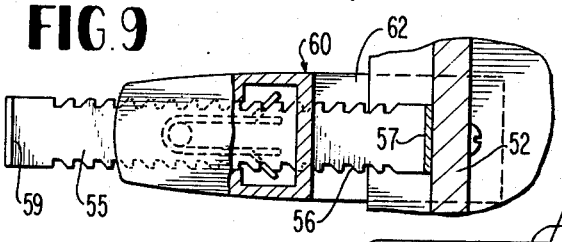
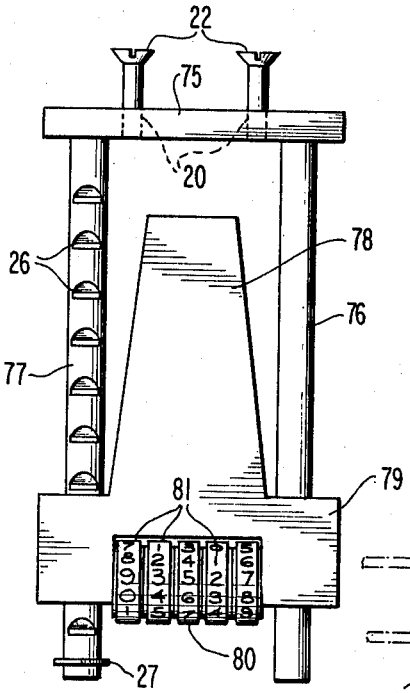
FIG.12
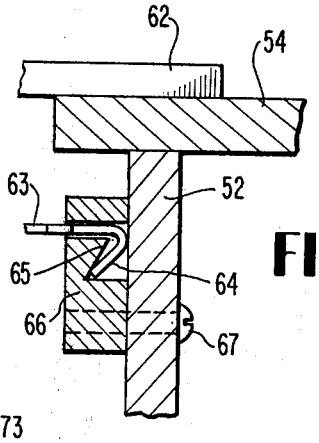
FIG.10
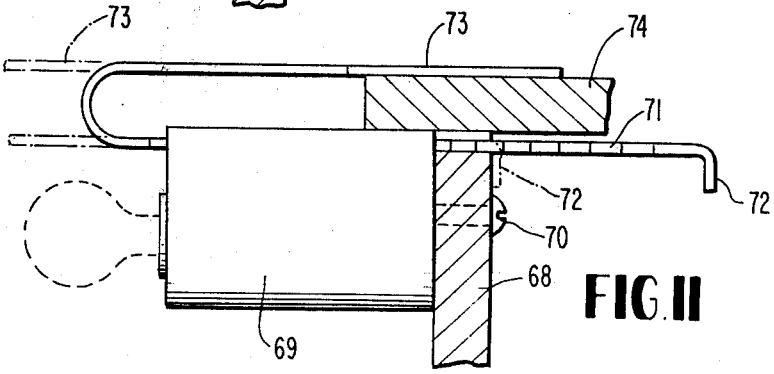
FIG.11

LOCK FOR MEDICINE CABINETS AND THE LIKE

BACKGROUND OF THE INVENTION

The need for medicine cabinet locks is well known and widely publicized in connection with the protection of small children by preventing their access to dangerous drugs and poisons. Millions of medicine cabinets are already in use in homes which possess no safety locking means and there is an urgent need for a practical and economical attachment lock for these existing cabinets which will render them safe without interference with their normal usage and without the necessity for defacing or drastically altering the existing cabinet structure. Ideally, the attachment safety lock should be such that it can be installed readily by the home owner with a minimum of expense and labor.

It is the objective of the invention, therefore, to satisfy the above-defined need by providing a simplified lock for medicine cabinet doors, and which is also applicable to a variety of additional cabinet closures, such as the drawers and doors of office filing cabinets, supply cabinets, gun cases and the like. The invention is characterized by its simplicity of construction, its sturdiness, its ease of installation and applicability to a variety of different types of cabinets such as those above enumerated. It can readily be installed on a medicine cabinet or another type of cabinet by the home owner, and the installation requires no more than the use of a hand drill for drilling a pair of mounting holes and a screwdriver for attaching the base of the invention to a cabinet side wall.

Another virtue of the invention, particularly in certain embodiments thereof, is that it is compatible with the basic mechanisms of certain conventional types of portable locks, thus rendering it economical and practical to manufacture by certain established manufacturers of locks without significant tooling changes.

Other features and advantages of the invention will become apparent during the course of the following detailed description.

BRIEF DESCRIPTION OF DRAWING FIGURES

FIG. 1 is a persepctive view of a typical medicine cabinet equipped with the attachment lock embodying the invention.

FIG. 2 is a perspective view of the lock in the active or locking position relative to the cabinet door.

FIG. 3 is a horizontal cross section taken through the lock and cabinet, parts in elevation.

FIG. 4 is a fragmentary horizontal section through the lock taken on line 4—4 of FIG. 2.

FIG. 5 is a fragmentary vertical section taken on line 5—5 of FIG. 3.

FIG. 6 is a fragmentary horizontal section similar to FIG. 3 showing a modification of the invention applicable to cabinets having thin metal walls.

FIG. 7 is a perspective view of the invention as applied to a filing cabinet or the like to lock a drawer thereof.

FIG. 8 is a plan view showing a modified form of attachment lock according to the invention.

FIG. 9 is a side elevational view of the lock in FIG. 8, with parts broken away.

FIG. 10 is a fragmentary view, similar to FIG. 8, showing a further modification.

FIG. 11 is a further view, similar to FIG. 8, showing still another modification.

FIG. 12 is a side elevational view of a lock of the permutation type also embodying the invention.

DETAILED DESCRIPTION

Referring to the drawings in detail wherein like numerals designate like parts, and referring first to FIGS. 1 through 5, the numeral 15 designates in its entirety a safety attachment lock for cabinets such as medicine cabinets in the home. Such medicine cabinets frequently have vertical side walls 16 which project somewhat forwardly of the wall on which the cabinet is mounted, with the horizontally swinging cabinet door 17 spaced considerably forwardly of the wall which is indicated at 18 in the drawings, FIGS. 1 and 3.

The lock assembly 15 includes a base or mounting plate 19 adapted to be placed against the exterior of the cabinet side wall 16 in the available space forwardly of the wall 18. The mounting plate 19 is equipped during manufacture with a pair of preferably threaded through openings 20 which are vertically spaced when the lock is in the normal installed position and located near the leading vertical edge of the mounting plate. The mounting plate 19 may be used as a template to assist the home owner in drilling a pair of holes 21 in the cabinet side wall 16 which will properly register with the threaded openings 20 and receive a pair of lock mounting screws 22, as indicated. The mounting arrangement depicted in FIGS. 1 to 5 is intended for cabinets having relatively thick side walls 16, such as wooden cabinets.

The lock assembly 15 further comprises, in one preferred form thereof, a pair of spaced parallel guide and retainer bars 23 and 24 extending at right angles to the mounting plate 19 and having their inner ends rigidly secured thereto. The bars 23 and 24 extend away from the cabinet wall 16 at right angles thereto for sufficient distances to accommodate the necessary movement of a lock body 25 supported and guided thereon.

The lower bar 24 in the illustrated embodiment is provided on one side thereof with a series of equidistantly spaced locking notches or detents 26 whose function will be fully described. One or both bars 23 and 24 are preferably equipped near their outer ends with retainer rings 27 to prevent the complete separation of the lock body 25 therefrom and thus preventing separation and loss of parts before or after installation of the lock.

The lock body 25 is a block-like body elongated in the direction between the two bars 23 and 24. It is bored through near its rear vertical side and near its top and bottom with a pair of bores 28 for the slidable reception of the bars 23 and 24, on which the lock body 25 is movable toward and away from the cabinet wall 16.

The lock body 25 contains a key operable turnable lock cylinder 29 whose key slot 30 is exposed at the upper end of the lock body during normal installation and usage. As best shown in FIG. 5, the cylinder 29 is received in a blind bore 31 formed in one end of the lock body. The cylinder 29 is equipped with conventional tumblers 32 whose operation in relation to a key is well known in the art and therefore will not be described in further detail herein. Suffice it to say that the tumblers are each biased by a small spring 33, FIG. 3, into a keyway or groove 34 which prevents rotation of the cylinder 29, sometimes called a plug, prior to entry through the slot 30 of a properly designed key. The cylinder 29 is bodily retained in the bore 31 by a conventional retainer ring 35 which snaps into a groove 36 when the cylinder is inserted into the bore 31.

At its leading end, the cylinder 29 has the usual spline 37 slidably contacting a spring urged shoe 38 secured to or formed integrally with a locking tooth 39, operating in a cross guideway 40 of the lock body 25. With the proper key inserted in the slot 30 to release all of the tumblers 32, the cylinder 29 may be turned in the lock body, and when this occurs, the coaction of spline 37 against shoe 38 will retract the locking tooth 39 from the particular detent notch 26 of the lock retainer bar 24. The tooth 39 is biased by a spring 41, FIG. 4, toward locking engagement with the detents 26, until released by rotation of the cylinder 29 and spline 37 in accordance with a conventional mode of operation. Whenever the tooth 39 is retracted from the detent notch 26 with which it is engaged, the entire lock body 15 is freely shiftable on the bars 23 and 24 toward and away from the cabinet side wall 16. The detent notches 26 and tooth 39 have corresponding inclined faces 42 and 43 to provide a ratchet action for the lock body 15 when moving in one direction toward the wall 16. However, when moving in the opposite direction away from the wall 16, engagement of the tooth 39 in any one of the notches 26 will positively lock the body 25 against further movement away from the wall 16.

The assembly 15 further comprises a rigid locking member, arm or "bolt" 44 adapted in the active position to overlie the cabinet door 17 to block the opening thereof. The bolt 44 is parallel to the line of movement of the lock body 25 and therefore parallel to the bars 23 and 24. It is spaced forwardly of the lock body 25 and joined thereto at its inner end by a short connecting portion 45 rigid with the lock body. When in a locking position relative to the cabinet door 17, FIGS. 2 and 3, the leading end of the bolt 44 is well ahead of the mounting plate 19 and projecting inwardly of cabinet side wall 16. When retracted to a door release position as shown in broken lines in FIG. 3, the bolt 44 is clear of the swinging vertical edge of the door 17 and the lock body 25 is near or against the retainer rings 27.

FIG. 6 shows a modification of the lock mounting means to facilitate installation on a cabinet side wall 16′ formed of thin sheet metal. All other parts of the invention remain unchanged. In FIG. 6, a flat mounting plate 46 similar to the plate 19 has threaded openings 47 receiving screws 48 which extend through drilled openings in the cabinet wall 16′. To reinforce this thin wall, however, an additional flat mounting plate 49 is placed on the interior face of the wall, whereby tightening of the screws 48 will draw the two plates 46 and 49 into secure clamping engagement with the wall 16′.

FIG. 7 illustrates the invention applied to a filing cabinet 50 or the like having a sliding drawer 51. As in the case of the medicine cabinet, the lock mounting plate 19 is applied to the cabinet side wall near and inwardly of the front face of the cabinet. The rigid locking arm or bolt 44 projects across the cabinet side wall at its front and overlaps the drawer 51 so as to block the opening of the drawer until the lock is released by a key and retracted.

FIGS. 8 and 9 show a modification of the invention wherein the structure of the attachment lock is compatible with one well known manufactured portable lock, for example the lock disclosed in U.S. Pat. No. 2,720,102, Spain. Therefore, with relatively small but important changes, the basic lock mechanism of the Spain patent can be adapted to the present invention in FIGS. 8 and 9 with obvious attendant economic advantages in terms of tooling and manufacturing procedures, compared to a totally new lock design.

In FIGS. 8 and 9, a cabinet side wall 52 projects forwardly of a room wall 53 and the cabinet door or closure is shown at 54. A combined locking bar, lock guide and mounting bar 55 is provided, having locking teeth 56 along its top and bottom edges which may be identical to the locking or ratchet teeth 20 in the Spain patent. At its inner end, a right angular flat mounting extension 57 is formed on the bar 55 for securement to the cabinet wall 52 by screws 58 or the like. The opposite end of the bar 55 has a short lateral extension 59 serving as a retainer for the movable lock body 60. This lock body 60 and its key operated plug or cylinder 61 may be identical in construction and operation to the locking mechanism in the Spain patent which cooperates with the ratchet teeth 56 on stationary locking bar 55. In the invention, however, instead of employing a lock body as a closure abutment element as in Spain, a rigid locking extension, arm or "bolt" 62, similar to the bolt 44, is carried by the lock body 60 in parallel relation to the bar 55 and outwardly thereof so as to be capable of lying forwardly of the cabinet door 54 to lock the same positively. In general, the mode of operation of the lock remains unchanged from the prior embodiments.

FIG. 10 shows a further modification of the arrangement in FIGS. 8 and 9 wherein the locking bar 63 may be the identical locking bar indicated at 11 in the Spain patent without modification. The hook or terminal 64 of the conventional bar 63 is held securely within a recess 65 formed in one face of a mounting and clamping lock 66 secured rigidly to the cabinet side wall 52 by screw means 67. The retainer element 59 shown in FIG. 8 is omitted to allow usage of the identical locking mechanism shown in the Spain patent without any alteration of the same except for the addition of the parallel closure locking member or bolt 62.

FIG. 11 shows a further modification of the invention in which the invention is compatible with a second commercial form of basic lock structure, namely that structure shown in U.S. Pat. No. 3,432,968, Foote, with only relatively minor changes.

In FIG. 11, the cabinet side wall 68 receives on its outer side fixedly a lock body 69 which may be the identical lock body and locking mechanism disclosed in the Foote patent. The lock body 69 is secured to the cabinet wall 68 by screw means 70. A ratchet tooth locking bar 71 is employed, similar to the bar 19 of Foote, and provided at its leading end with a short lateral terminal 72 serving as a stop to prevent complete separation of the movable bar 71 from the cabinet or lock body 69. In the invention, a reversely bent parallel longitudinal locking bar or sliding bolt 73 is formed integral with the ratchet bar 71 and overlaps the front face of cabinet door 74 when in the locking position. In this embodiment of the invention, the same parallel longitudinal relative movement between the locking body and locking bar is present, but in this case as contrasted with the prior embodiments, the lock body 69 is the relatively stationary element, while the ratchet locking bar 71 is the movable element and the bolt is carried by the movable locking bar instead of by the movable lock body, as in the prior embodiments. However, the general mode of operation remains the same, in relation to the cabinet closure 74.

In FIG. 12, another modification of the invention is depicted which is basically similar to the embodiments of FIGS. 1, 2 and 7. The same relationship of mounting plate 75 and guidance and retainer bars 76 and 77 exists as well as the general relationship of the bolt 78 and the lock body 79 carrying the bolt and being engaged adjustably with the two bars 76 and 77. However, in FIG. 12, instead of a key operated lock cylinder and plunger mechanism, a permutation lock mechanism 80 of any conventional type is provided on the lock body 79 so that the lock can be released only when the proper combination of digits on the permutation wheels 81 are known to the operator. In all other respects, the lock is the same as that shown in FIGS. 1 and 7.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. An attachment lock for cabinet closures comprising a lock body member having a longitudinal guide passage therethrough and a relatively movable locking bar member extending through said guide passage, one of which terminates in a flat mounting surface portion on one end thereof adapted for securement to the outer face of a cabinet side wall which is rearwardly of and at substantially right angles to a cabinet closure to be locked against forward movement relative to the side wall, the other of which quidably slides longitudinally parallel relative to the other between a locking position and a release position, said flat mounting surface portion positioned at substantially right angles to the plane of movement of the other said member and substantially aligned with the direction of movement of the cabinet closure, means for fixedly connecting said flat mounting surface portion to the outer face of the cabinet side wall, and a closure positive locking member carried bodily by one or the other of said lock body member or locking bar member and lying in a plane parallel to the locking bar member and spaced laterally therefrom, said closure positive locking member adapted to assume a locking position relative to said closure when the lock body member and locking bar member are slidably moved relatively in one longitudinal direction and adapted to assume a retracted closure release position when the lock body member and locking bar member are slidably moved relatively in an opposite longitudinal direction, and a one way free moving one way positively engaging lock mechansim on the lock body and locking bar member in cooperative relation thereon.

2. An attachment lock as defined in claim 1 in which the locking bar member is adapted for securement to the outer face of a cabinet side wall and is stationary relative to the lock body member when the attachment lock is installed, and said closure positive locking member being carried by said lock body member.

3. An attachment lock as defined in claim 2, and said locking bar member comprising a ratchet toothed locking bar, said flat mounting surface portion comprising a first lateral extension at one end of said locking bar member attachable to a cabinet side wall and a second lateral extension at the opposite end thereof forming a stop to limit movement of the lock body away from a cabinet side wall, the lock body being captive on the locking bar between said first and second lateral extensions.

4. An attachment lock as defined in claim 2, and said locking bar member being a toothed locking bar having a hook-like extension on its leading end, and said flat mounting surface portion on one end of said locking bar member comprising a separate clamping retainer element captively engaging the hook-like extension and adapted to be secured to the outer face of a cabinet side wall for holding the hook-like extension clampingly between the outer face of the side wall and said retainer element when said retainer is secured to the cabinet side wall.

5. An attachment lock for cabinet closures comprising a lock body and a relatively movable locking bar member, said lock body adapted for securement to a cabinet side wall rearwardly of a cabinet closure to be locked against forward movement and is stationary relative to the locking bar member when the attachment lock is installed, and a closure positive locking member attached to and carried bodily by said locking bar member and lying in a plane parallel to the locking bar member and spaced laterally therefrom, said closure positive locking member adapted to assume a locking position relative to said closure when the lock body and locking bar member are moved relatively in one direction and adapted to assume a retracted closure release position when the lock body and locking bar member are moved relatively in an opposite direction, and a one way free moving one way positively engaging lock mechanism on the lock body and locking bar member in cooperative relation thereon.

6. An attachment lock as defined in claim 5, and said locking bar member having a movement limiting stop on one end thereof adapted to engage the interior side of a cabinet side wall, said closure positive locking member being attached to the other end of the locking bar member and extending from such end toward said stop in spaced parallel relation to the locking bar member, said lock body being captive on the locking bar member between said stop and closure positive locking member.

7. An attachment lock for cabinet closures comprising a lock body having a longitudinal guide passage therethrough and a relatively movable locking bar member extending through said guide passage, a mounting plate secured to one end of the locking bar member and adapted for securement to the outer face of a cabinet side wall rearwardly of a cabinet closure to be locked against forward movement whereby said locking bar member is stationary relative to the lock body when the attachment lock is installed, said lock body slidable longitudinally parallel relative to said locking bar member between a locking position and a release position, and a closure positive locking member carried bodily by said lock body and lying in a plane parallel to the locking bar member and spaced laterally therefrom, said closure positive locking member adapted to assume a locking position relative to said closure when the lock body and locking bar member are slidably moved relatively in one longitudinal direction and adapted to assume a retracted closure release position when the lock body and locking bar member are slidably moved relatively in an opposite longitudinal direction, and a one way free moving one way positively engaging lock mechanism on the lock body and locking bar member in cooperative relation thereon.

8. An attachment lock as defined in claim 7, and said lock mechanism comprising a key operable tumbler lock within the lock body.

9. An attachment lock as defined in claim 7, and said lock mechanism comprising a permutation lock mechanism on the lock body.

10. An attachment lock as defined in claim 7, and said mounting plate having a pair of spaced screw-threaded openings adapted to receive screws extending through the cabinet side wall from the interior of such wall.

11. An attachment lock as defined in claim 7, in which said mounting plate is secured rigidly to one end of said locking bar member and being engageable with the exterior face of a cabinet side wall and having a pair of spaced screw-threaded openings, and a reinforcing mounting plate on the interior face of a cabinet side wall and having screw receiving openings in registry with said screw-threaded openings whereby the lock is adaptable to sheet metal cabinet structures.

12. An attachment lock as defined in claim 7, and said locking bar member having a series of ratchet locking teeth formed thereon with intervening locking notches, a guidance and stabilizing bar spaced from the locking bar in parallel relation thereto and coextensive therewith, said lock body having a pair of through bores slidably receiving said locking bar and guidance and stabilizing bar, and said lock mechanism including a locking tooth biased toward locking engagement within the notches of the locking bar between the ratchet teeth thereof.

13. An attachment lock as defined in claim 12, and said lock mechanism additionally comprising a key operable rotary tumbler cylinder within the lock body and having a driving spline operable to retract the locking tooth when said tumbler cylinder is turned.

14. An attachment lock for cabinet closures comprising a lock body and a relatively movable locking bar member, said locking bar member adapted for securement to a cabinet side wall rearwardly of a cabinet closure to be locked against forward movement and is stationary relative to the lock body when the attachment lock is installed, a closure positive locking member carried bodily by said lock body and lying in a plane parallel to the locking bar member and spaced laterally therefrom, a guidance and stabilizing bar spaced fom the locking bar in parallel relation thereto and coextensive therewith, said lock body having a pair of through bores slidably receiving said locking bar and guidance and stabilizing bar, a lock body retainer element on the end of the locking bar member or the guidance and stabilizing bar remote from a cabinet side wall on which the lock is installed, a mounting plate fixed to the other ends of said locking bar member and guidance and stabilizing bar and adapted for attachment to the outer face of a cabinet side wall, said closure positive locking member adapted to assume a locking position relative to said closure when the lock body is moved relative to said locking bar member and guidance and stabilizing bar in one direction and adapted to assume a retracted closure release position when the lock body is moved relative to said locking bar member and guidance and stabilizing bar in an opposite direction, and a one way free moving one way positively engaging lock mechanism on the lock body and locking bar member including a series of ratchet locking teeth formed on said locking bar member with intervening locking notches, and a locking tooth carried by the lock body and biased toward locking engagement within the notches of the locking bar between the ratchet teeth thereof.

15. An attachment lock as defined in claim 12, and said mounting plate having at least a pair of screw-threaded openings formed therethrough.

16. An attachment lock as defined in claim 14, and said locking bar and guidance and stabilizing bar being vertically spaced when in the installed position, and said lock mechanism including a key-operable rotary tumbler cylinder within the lock body operative to retract said locking tooth when said tumbler cylinder is turned, said lock body extending vertically between said bars with said key-operable rotary tumbler cylinder facing upwardly, and said closure positive locking member comprising a substantially rigid bar-like locking member secured to the vertical side of the lock body which is disposed forwardly when in the installed position.

* * * * *